US006457656B1

(12) United States Patent
Scott

(10) Patent No.: US 6,457,656 B1
(45) Date of Patent: Oct. 1, 2002

(54) POP-UP SPRINKLER WITH INWARDLY DEFLECTABLE VELOCITY CONTROL DISC

(75) Inventor: Loren W. Scott, Carlsbad, CA (US)

(73) Assignee: Hunter Industries, Inc., San Maros, CA (US)

( * ) Notice: Subject to any disclaimer, the term of this patent is extended or adjusted under 35 U.S.C. 154(b) by 56 days.

(21) Appl. No.: 09/663,106

(22) Filed: Sep. 15, 2000

(51) Int. Cl.[7] ..... B05B 15/10
(52) U.S. Cl. ..... 239/205; 239/206
(58) Field of Search ..... 239/237, 200, 239/201, 203–206, 570; 251/48, 50; 137/514.5, 516.27

(56) References Cited

U.S. PATENT DOCUMENTS

| | | | | |
|---|---|---|---|---|
| 2,909,325 A | | 10/1959 | Hunter | 239/97 |
| 3,029,834 A | | 4/1962 | Vanden Hoek | 137/514.5 |
| 4,874,066 A | | 10/1989 | Silberstein | 188/280 |
| 5,174,501 A | * | 12/1992 | Hadar | 239/205 |
| 5,638,860 A | | 6/1997 | DeRoche | 137/493.8 |
| 5,735,768 A | | 4/1998 | Sudau | 475/347 |
| 5,927,607 A | | 7/1999 | Scott | 239/205 |

* cited by examiner

*Primary Examiner*—Lisa A. Douglas
(74) *Attorney, Agent, or Firm*—Michael H. Jester

(57) ABSTRACT

A pop-up sprinkler includes an outer housing having an inlet passage and an inlet for connection to a source of pressurized fluid. A riser is mounted in the housing for moving from a normally retracted position to an operative extended position in response to fluid pressure. A pressure responsive inlet valve assembly is mounted in the outer housing adjacent the inlet passage and includes a valve seat and a valve member. The inlet valve assembly further includes a velocity control disc that is biased into engagement with the valve seat. The velocity control disc initially meters inlet fluid for limiting a rate of opening of the valve member for controlling flow of fluid through the inlet and extension of the riser to the extended position. The velocity control disc is made of an elastomeric material and is deflectable radially inwardly to accommodate debris.

20 Claims, 5 Drawing Sheets

POP-UP SPRINKLER WITH INWARDLY DEFLECTABLE VELOCITY CONTROL DISC

BACKGROUND OF THE INVENTION

The present invention relates to irrigation sprinklers, and more particularly, to an improved velocity control disc for an inlet valve assembly of a pop-up sprinkler.

The use of irrigation systems for watering plants where rainfall is inadequate is common throughout the world today. One of the most widely used systems, particularly for lawns and athletic fields, is a sprinkler system wherein a plurality of pop-up sprinklers are positioned about a land area for uniformly distributing water in accordance with a watering program executed by a controller. These sprinklers have a telescoping riser which retracts into a fixed sub-surface housing when not in use. When pressurized water is supplied to the sprinkler, the riser extends or pops-up from the sub-surface housing to eject a stream of water.

Sprinklers of this type are widely used on golf courses and other turf applications. These are usually high pressure systems and are frequently subjected to significant forces each time water is supplied to them, particularly when they are supplied with a high pressure combination of air and water. These high forces over a lifetime of use can damage sprinklers and reduce their useful life. The highest forces result when a sprinkler is subjected to surge conditions, such as when the system is being winterized or being refilled with water in the spring. In climates where irrigation systems are subject to freezing, the water must be removed from the system before winter. The water is purged from the system by means of compressed air. The compressed air acts much more rapidly than water and usually results in the risers shooting up rapidly with very high forces resulting in damage to the sprinklers. High surge forces also frequently occur when empty pipes are being filled with water. As the lines are being filled, air or a combination of water and air is forced into each sprinkler and vented through the same. Under these conditions the riser frequently shoots up at a high velocity and is slammed against the stationary outer housing with relatively great force.

Attempts to solve this problem by making the sprinklers heavier and stronger have been unsatisfactory because of increased costs. The dual medium of water and air makes unsatisfactory the use of slow opening valves to control the out-flow.

Another problem frequently encountered in so-called "valve-in-head" sprinklers is that large particles get trapped between the moving valve member and seat during closing of the valve. This results in continuous leakage until the sprinkler is cycled again. The valve seat can also be damaged.

Therefore, there is a need for a means for reducing the extension velocity of the riser of a pop-up sprinkler in order to prolong its life. There is also a need for a valve-in-head sprinkler design that reduces the tendency for large particles to become trapped against the valve seat.

Accordingly, it would be desirable that a sprinkler be available having a means for reducing the riser extension velocity to prevent the resultant high forces and consequential damage. It would also be desirable that a sprinkler have some means for reducing the tendency for large particles to become trapped against the valve seat.

SUMMARY AND OBJECTS OF THE INVENTION

Accordingly, it is a primary object of the present invention to provide a pop-up sprinkler having an improved inlet valve assembly for controlling riser extension velocities and reducing high forces normally resulting therefrom.

In accordance with the present invention, a pop-up sprinkler includes an outer housing having an inlet passage and an inlet for connection to a source of pressurized fluid. A riser is in the housing for moving from a normally retracted position to an operative extended position in response to fluid pressure. A pressure responsive inlet valve assembly is mounted in the outer housing adjacent the inlet passage and includes a valve seat and a valve member. The inlet valve assembly further includes a velocity control disc that is biased into engagement with the valve seat. The velocity control disc initially meters inlet fluid for limiting a rate of opening of the valve member for controlling flow of fluid through the inlet and extension of the riser to the extended position. The velocity control disc is made of an elastomeric material and is deflectable radially inwardly to accommodate debris.

BRIEF DESCRIPTION OF THE DRAWINGS

The above and other objects and advantages of the present invention will become apparent from the following description when read in conjunction with the drawings wherein.

Throughout the drawing figures, like reference numerals refer to like parts.

DETAILED DESCRIPTION OF THE PREFERRED EMBODIMENTS

Figure 1:
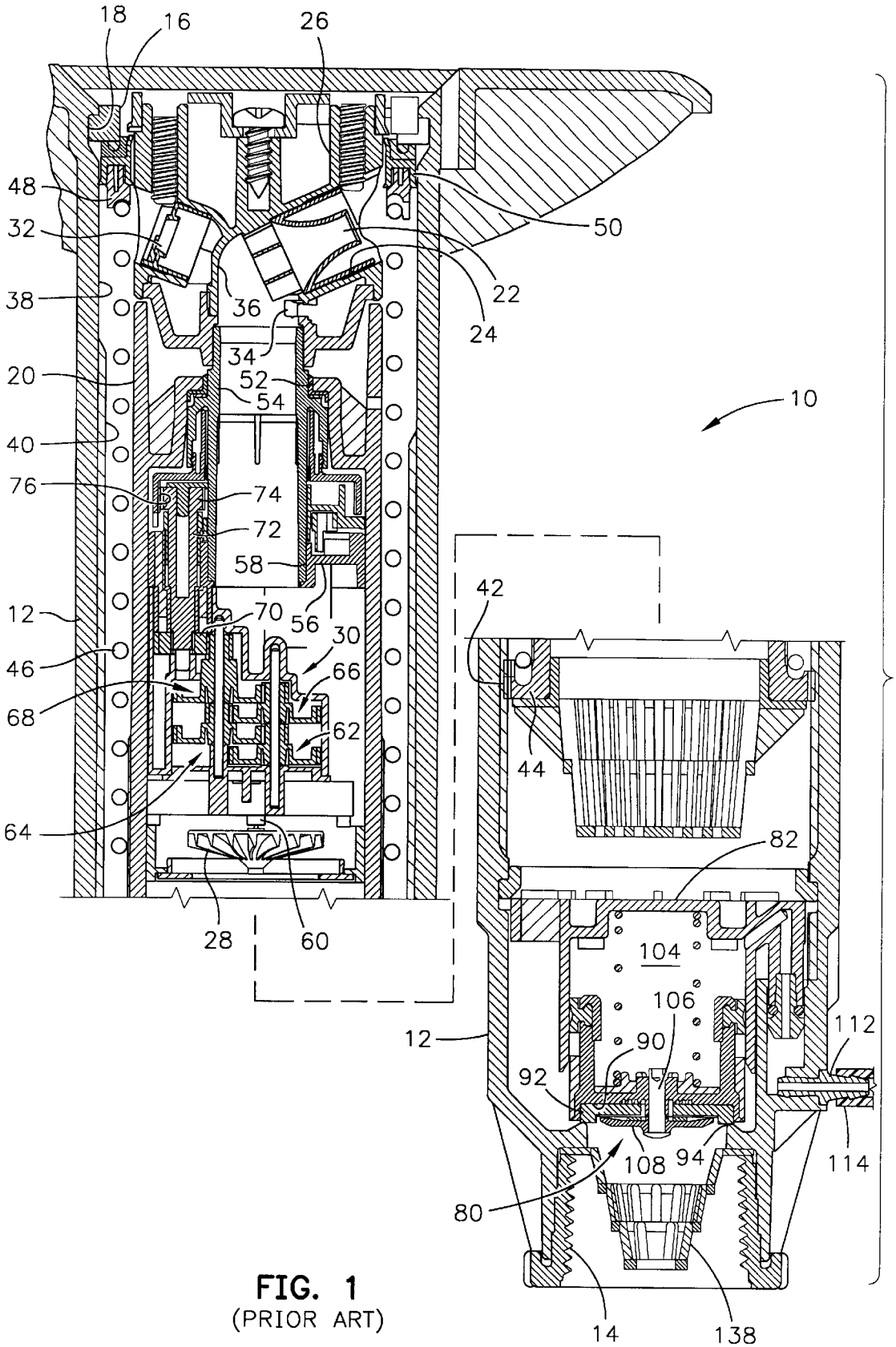
FIG. 1 (PRIOR ART)
FIG. 1 is a vertical sectional view of a prior art pop-up sprinkler incorporating a conventional inlet valve assembly.

Referring to FIG. 1, there is illustrated a conventional pop-up sprinkler 10. It includes a generally cylindrical tubular outer housing 12 having a threaded inlet 14 at a lower end for mounting to the end of a threaded pipe or the like (not illustrated) connected to a supply line. The supply line is typically a PVC pipe that is connected to a source of pressurized fluid which may be water, air, or a combination of water and air. An upper outlet end of the housing 12 is provided with a split retaining ring 16 detachably mounted in an annular recess 18 for securing a retractably mounted cylindrical tubular inner housing or riser 20.

The riser 20 (FIG. 1) is retractably mounted inside the outer housing 12 for extension upwardly therefrom. The riser 20 includes a nozzle 22 mounted in an upper or outer end thereof for distributing a stream of water therefrom. The nozzle 22 is mounted in a passage or socket 24 in a head 26 that is rotatably driven by means of a turbine 28 through a reduction gear drive train 30, as more fully described hereafter.

The particular sprinkler 10 (FIG. 1) is designed for watering golf courses and playing fields. The nozzle 22 rotates in a partial or full circle about a central vertical axis of the outer housing 12. A second nozzle 32 is mounted in the head 26 opposite the nozzle 22. The nozzle 32 communicates via a port 34 with a through passage 36 to improve the distribution of the stream of water closer in to the sprinkler 10.

The riser 20 (FIG. 1) is retractably mounted within a bore 38 of the outer housing 12, and is oriented by a plurality of circumferentially spaced internal ribs 40 and by means of teeth 42 on radial flange 44 at the lower end thereof An elongated coil compression spring 46 engages a shoulder or flange 44 at the lower end of the riser 20, and is confined within the bore by means of the retaining ring 16 at the upper end. The riser 20 is normally biased by the coil spring 46 to its lowermost or retracted position, as illustrated in FIG. 1, when the water pressure is shut off. The spring 46 is positioned between the annular flange 44 and a ring 48 at the upper end of the housing 12, which biases against an outer annular seal assembly 50 retained in position by the retaining ring 16.

The riser 20 (FIG. 1) carries the rotating head 26 from its retracted position in the outer housing 12 to an extended position above the ground surface where the head 26 rotates and distributes water. The riser 20 converges at the top with inwardly tapering walls to an opening 52 in which is rotatably mounted a tubular shaft 54, having an upper end extending above the upper end of housing 20 and upon which the rotating head 26 is mounted. The shaft 54 serves to mount the head 26 to convey water from the inlet 14 to the outlet nozzles 22 and 32. The shaft 54 also transfers torque from the gear drive train 30 to the rotating head 26.

The driving assembly for rotating the head 26 is mounted in the riser 20 and includes support structure 56 having a journal 58 in which the lower end of the tubular shaft 54 is rotatably mounted. A shoulder surrounds the opening 52 and is engaged by a shoulder on rotary shaft 54.

The turbine 28 rotates in response to water flowing upwardly through the sprinkler 10. The turbine 28 is mounted on a shaft 60 which drivingly rotates a pinion gear which meshes with and drives a reduction gear unit 62 having a larger driven gear and a smaller pinion gear. The reduction gear unit 62 further drives a reduction gear 64 which in turn drives a reduction gear unit 66 further driving a reduction gear 68. The reduction gear 68 is the final drive component in the reduction drive gear train 30. The gear 68 meshes with a gear 70 on a shaft 72 for driving a pinion 74 which in turn drives an internal ring gear 76 which drives the tubular shaft 54. inlet valve assembly 80 (FIG. 1) is mounted inside the lower end of the outer housing 12 adjacent the inlet 14 and controls fluid entering the sprinkler 10. The valve assembly 80 also functions as a check valve in that it prevents back flow. The valve assembly 80 comprises a housing 82 (FIG. 2) which may or may not be integral with the outer housing 12. The housing 82 is shown as a separate insert in FIG. 2. The housing 82 is of a generally cylindrical configuration and is positioned coaxially within the bore of outer housing 12 adjacent the inlet 14. The housing 82 includes an outer cylindrical wall 84 having an internal bore 86 in which a generally cylindrical valve member 88 is reciprocally mounted.

Figure 2:
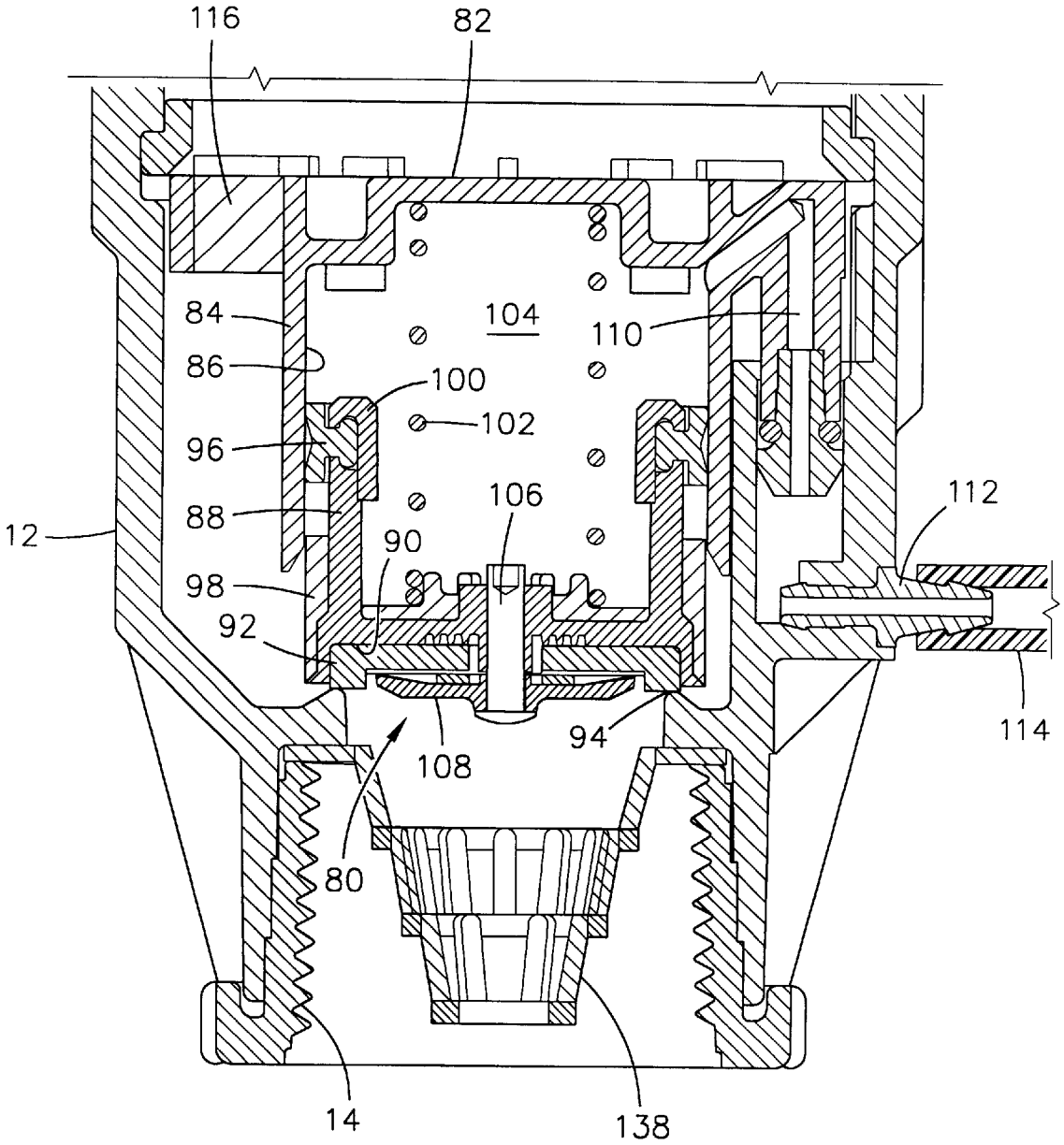
FIG. 2 (PRIOR ART)
FIG. 2 is an enlarged vertical sectional view showing further details of the inlet valve assembly illustrated in FIG. 1.

The valve member 88 (FIG. 2) has a generally cylindrical configuration including a circular face 90 (FIG. 1) on which is mounted an elastomeric valve seal 92 (FIG. 2) for sealingly engaging an annular valve seat 94 surrounding the inlet 14. The valve member 88 is reciprocally mounted in the bore 86 by means of an annular seal 96 and guided by a plurality of ribs 98. An annular retainer ring 100 threadably mounts to the interior of the valve seal 92 and retains the seal 96 in place. A coil-type spring 102 normally biases the valve member 88 to its closed or seated position as shown in FIGS. 1 and 2.

The valve member 88 (FIG. 2) closes the bore 86 forming a closed chamber 104 which is normally pressurized to maintain the valve member 88 in its closed or seated position. A rivet 106 engages a retaining and strainer washer disc 108 which engages and retains the valve seal 92 on the face of the valve member 88. Pressurized fluid from the inlet 14 flows very slowly past slots in the edge of disc 108 via a tortuous passage through the face 90 of valve member 88 into chamber 104 and maintains the valve member 88 in its normally closed position. Further details of this construction are described in U.S. Pat. No. 5,979,863, of Bradley M. Lousberg, granted Nov. 9, 1999, entitled, "Irrigation Control Valve and Screen", the entire disclosure of which is specifically incorporated herein by reference.

The chamber 104 is vented via a passage 110 (FIG. 2) in the housing 82 and an outlet 112 in the outer housing 12 by a remotely controlled solenoid or hydraulically actuated valve (not shown). The outlet 112 is connected to the solenoid or hydraulically actuated valve by a hose 114. This venting enables inlet fluid to open the valve member 88. When the valve member 88 is in its raised open position, water from the inlet 14 can flow radially outwardly past the valve seat 94 and through flow passages between circumferentially spaced ribs 116. When the incoming fluid is air or a mixture of air and water, the valve member 88 may open rapidly causing a very rapid extension of the riser 20, which may damage the sprinkler 10.

Figure 3:
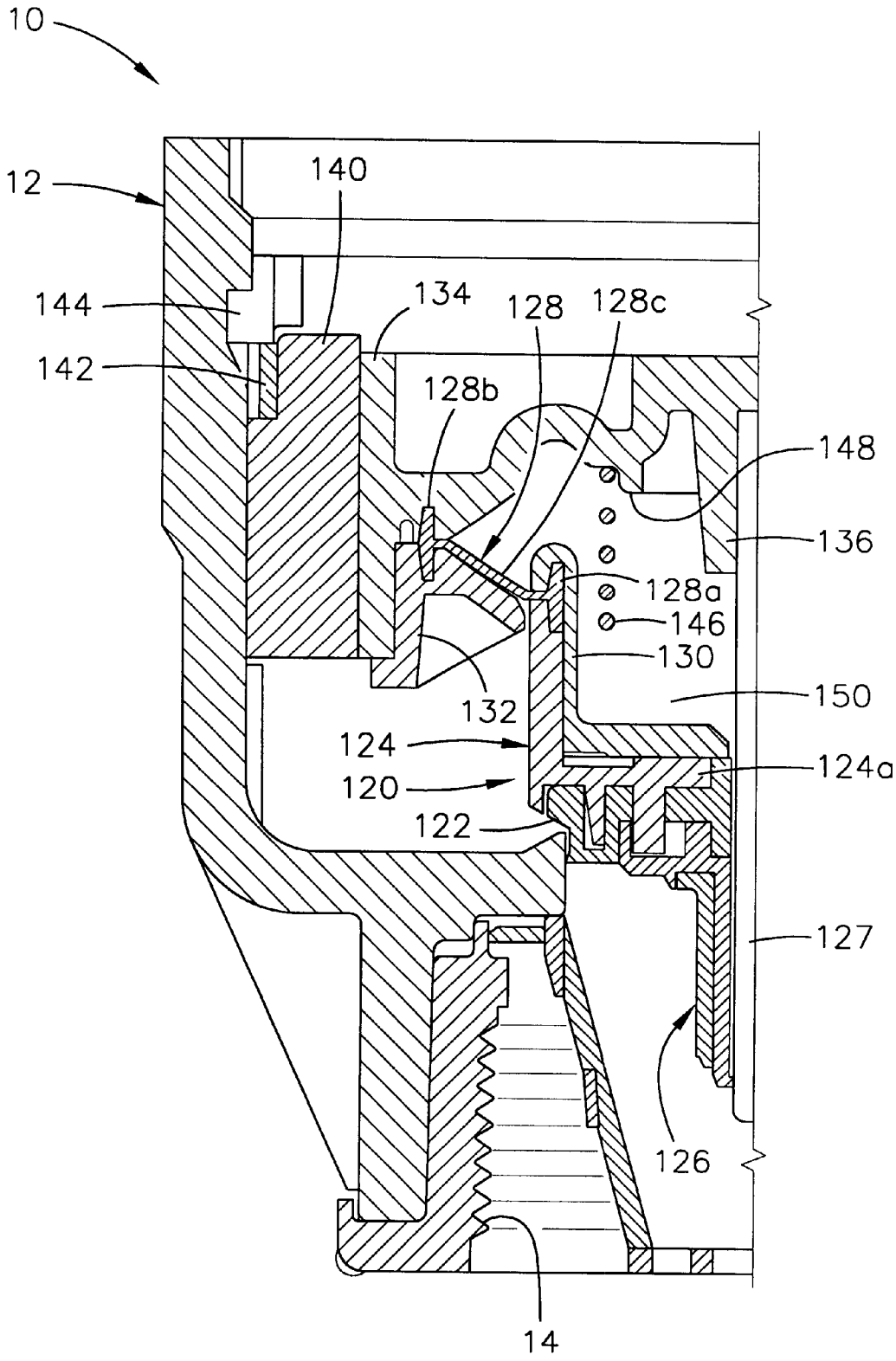
FIG. 3 is an enlarged fragmentary vertical sectional view showing details of the left half of a preferred embodiment of the inlet valve assembly of the present invention in its closed position.
Figure 4:
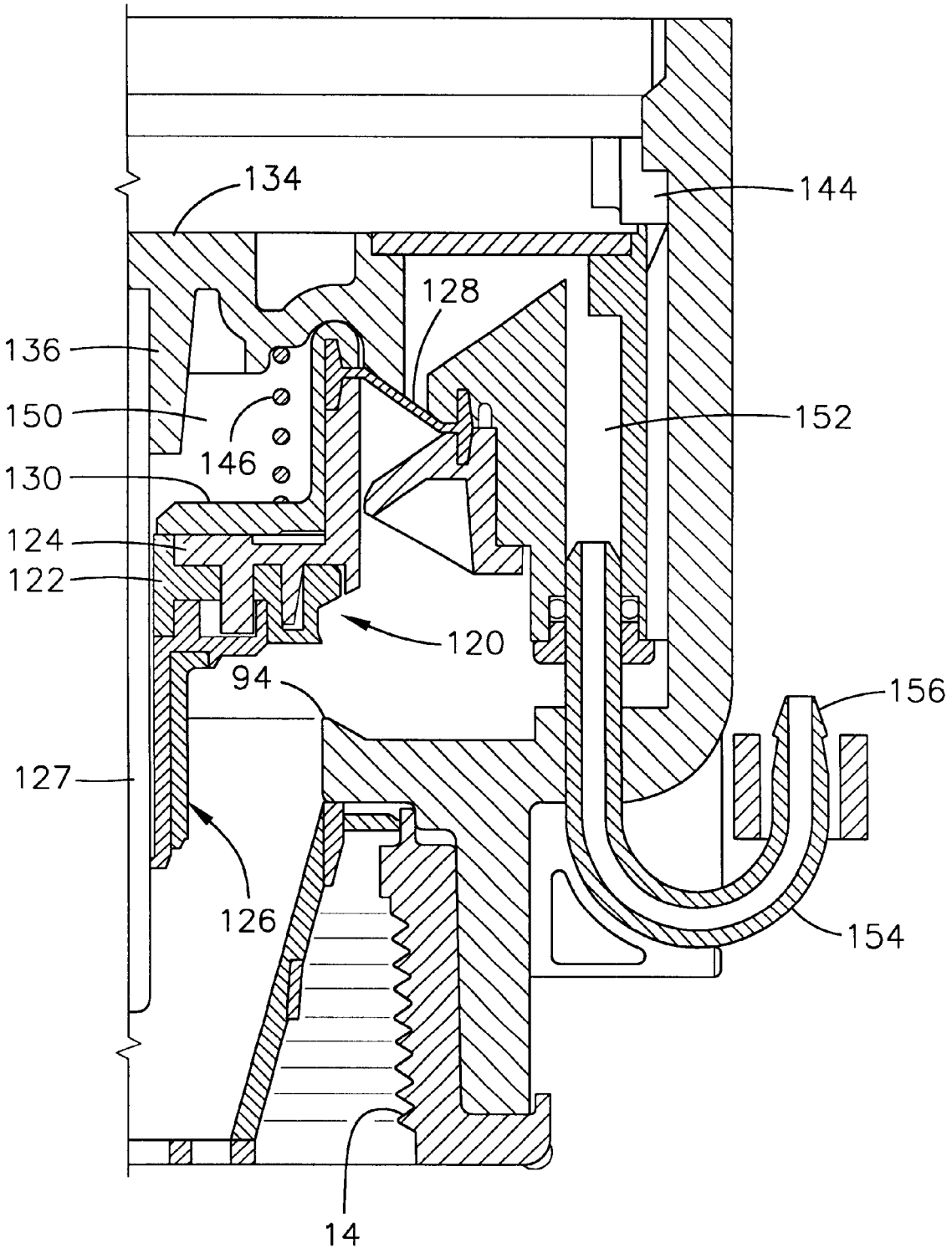
FIG. 4 is a view similar to FIG. 3 showing details of the right half of the inlet valve assembly in its open position.

In accordance with the present invention, the sprinkler 10 has a modified inlet valve assembly 120 illustrated in FIG. 3. An elastomeric velocity control disc 122 is mounted in overlapping fashion concentric with the circular base 124*a* of a cylindrical valve member 124. A lower valve metering assembly 126 surrounds a metal metering rod 127. The velocity control disc 122 is sandwiched between the lower valve metering assembly 126 and the circular base 124*a* of the valve member 124. The valve member 124 is supported for vertical reciprocation by a flexible elastomeric hinge valve member 128. The radially inward lip 128*a* of the hinge valve member 128 is held against the upper circular edge of the valve member 124 by the wrap-around upper annular edge of a cylindrical mounting cup 130. The radially outward lip 128*b* of the hinge valve member 128 is clamped between a lower cylindrical retainer 132 and an upper cylindrical cover member 134. The upper end of the metering rod 127 is snugly received inside a socket 136 integrally formed on the underside of the cover member 134. A plurality of radially, extending, circumferentially and axially spaced fins 140 connect the cover member 134 to a circular rim 142 held in place in the outer housing 12 by a split snap ring 144. The fins 140 center the cover member 134. The spaces between the fins 140 define major flow paths for water flowing from the inlet 14 past the valve seat 94 when the inlet valve assembly 120 is in its raised open position illustrated in FIG. 4. The lower retainer 132 and upper cover member 134 have inclined opposing walls that form a region with a V-shaped cross-section for limiting upper and lower movement of the central flexible web 128*c* of the elastomeric hinge valve member 128. The upper end of a coil spring 146 surrounds a cylindrical shoulder 148 integrally formed on the underside of the cover member 134. The lower end of the coil spring 146 engages the flat bottom wall of the mounting cup 130 to bias the inlet valve assembly 120 to its closed position illustrated in FIG. 3.

An upper pressure chamber 150 (FIG. 3) in the inlet valve assembly 120 is selectively vented via passage 152 (FIG. 4) through a C-shaped hose 154 terminating in a barbed fitting 156. The barbed fitting 156 is connected via another hose (not illustrated) to a solenoid actuated or hydraulically actuated pilot valve (not illustrated).

The velocity control disc 122 (FIG. 3) has a generally disc shaped configuration with a serpentine cross-section. The velocity control disc 122 has a radially inwardly tapered outer peripheral wiper 122*a* (FIG. 5) that engages (or provides a close fit with) the wall of the valve seat 94 and the passage leading to the inlet 14 to meter the incoming air and/or water during initial opening of the inlet valve assembly 120. This results in a slower pop-up stroke of the riser 20 and/or a lower impact at the end of its stroke. The velocity control disc 122 also acts to strain relatively large debris particles such as 160 during closing as the velocity control disc 122 can deflect radially inwardly and keep the debris particle 160 from being trapped between the velocity control disc 122 and valve seat 94. The valve member 124 has a radially inwardly tapered wall 124*b* that normally provides a gap between the velocity control disc 122 and the valve member 124. This gap is visible in FIGS. 3 and 4. The gap disappears when the large debris particle 160 (FIG. 5) pushes the outermost portion of the velocity control disc 122 inwardly.

Figure 5:
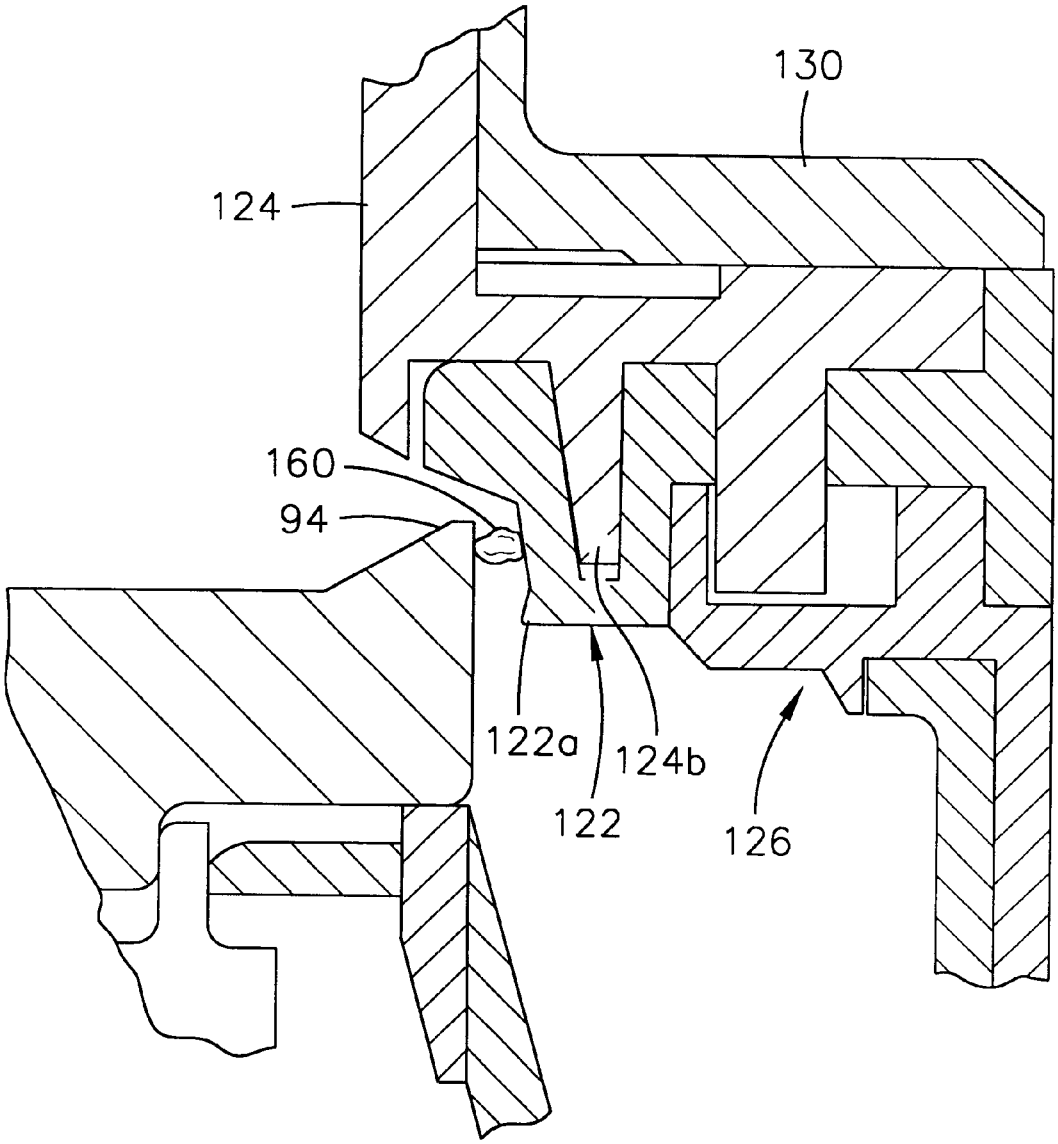
FIG. 5 is an enlarged fragmentary vertical sectional view of the valve seat and velocity control disc of the inlet valve assembly of FIG. 3 when the inlet valve assembly is in its closed and a piece of grit is lodged against the valve seat and is deflecting the velocity control disc inwardly.

In operation, when a fluid such as air and/or water is supplied under high pressure to the inlet of the sprinkler 10 and the chamber 150 (FIG. 3) is vented. The inlet fluid acts against the lower face of the inlet valve assembly 120 to force it away from the seat 94. Fluid initially begins flowing around the peripheral edge of the velocity control disc 122 and is initially metered, resulting in a slower opening of the valve member 124 and a slower flow of fluid into the sprinkler 10. This results in a slower movement of the riser 20 to its extended position and lessens the resulting impact force when the coil spring 46 (FIG. 1) reaches the end of its compression. The velocity control disc 122 thus serves as a metering or damping means. When the inlet valve assembly 120 is being closed or shut down after a run cycle of the sprinkler 10, the elastomeric velocity control disc 122 extends into the inlet passage immediately upstream of the female threaded inlet 14. The velocity control disc 122 begins metering the water and forcing it at high across the valve seat 94. This flushes debris such as the particle 160 away from the seat 94 to insure a more complete seal. The disc 122 also deflects or deforms to prevent damage to the valve seat 94 by the debris particle 160. The velocity control disc 122 may have notches around its peripheral edges, as shown in FIG. 5 of my U.S. Pat. No. 5,927,607. This provides additional fluid bleed.

While I have illustrated and described my invention by means of specific embodiments, it should be understood that numerous changes and modifications may be made therein without departing from the spirit and scope of the invention as defined in the appended claims:

I claim:

1. A pop-up sprinkler, comprising:

an outer housing having an inlet passage and an inlet for connection to a source of pressurized fluid;

a riser mounted in the outer housing for moving from a normally retracted position to an operative extended position in response to fluid pressure; and a pressure responsive inlet valve assembly mounted in the outer housing adjacent the inlet passage, the inlet valve assembly including a valve seat, a valve member and a velocity control disc biased into engagement with the valve seat, the velocity control disc initially metering inlet fluid for limiting a rate of opening of the valve member for controlling flow of fluid through the inlet and extension of the riser to the extended position, the velocity control disc being made of an elastomeric material and being deflectable radially inwardly to accommodate debris.

2. The sprinkler of claim 1 wherein the valve member and the velocity control disc are configured to provide a gap therebetween that allows a portion of the velocity control disc to deflect inwardly.

3. The sprinkler of claim 1 wherein the velocity control disc has a wiper formed on an outer peripheral edge thereof which engages the valve seat.

4. The sprinkler of claim 1 wherein the inlet valve assembly includes a metering assembly.

5. The sprinkler of claim 4 wherein the velocity control disc is sandwiched between the valve member and the metering assembly.

6. The sprinkler of claim 1 wherein the inlet valve assembly includes an upper pressure chamber and a passage for venting the upper pressure chamber.

7. The sprinkler of claim 1 wherein the inlet valve assembly includes a cover member, a circular rim and a plurality of circumferentially spaced fins connecting the cover member and the rim to define a plurality of water flow passages.

8. The sprinkler of claim 1 wherein the inlet valve assembly includes a cover member and the valve member is supported for vertical reciprocation by a flexible hinge valve member connected to the cover member.

9. The sprinkler of claim 1 and further comprising a metering rod extending axially through a center of the valve member.

10. The sprinkler of claim 1 wherein the valve member has an inwardly tapered wall and the velocity control disc is normally separated from the tapered wall to provide a gap therebetween that allows a portion of the velocity control disc to deflect inwardly to accommodate a debris particle.

11. A pop-up sprinkler, comprising:

an outer housing having an inlet at its lower end;

a riser reciprocably mounted in the outer housing and moveable between retracted and extended positions in response to the introduction of pressurized fluid into the outer housing through the inlet;

a nozzle mounted in an upper end of the riser;

a turbine mounted in the riser;

drive means for coupling the turbine to the nozzle so that water flowing through the turbine will rotate the nozzle; and an inlet valve assembly mounted in the outer housing below the riser including a reciprocable valve member having a velocity control disc mounted thereon which can engage and disengage a valve seat to initially meter the inflow of fluid through the inlet to the riser to limit a of movement of the riser to the extended position, the velocity control disk having a portion that is deflectable radially inwardly to accommodate a particle of debris between the velocity control disk and the valve seat.

12. The sprinkler of claim 11 wherein the valve member has an inwardly tapered wall and the portion of the velocity control disc is normally separated from the tapered wall to define a gap therebetween.

13. The sprinkler of claim 11 wherein the velocity control disc is made of an elastomeric material.

14. The sprinkler of claim 11 wherein the velocity control disk has a serpentine cross-section.

15. The sprinkler of claim 11 wherein the velocity control disk has a wiper formed on an outer peripheral edge thereof which engages the valve seat.

16. The sprinkler of claim 11 wherein the valve seat is formed as part of the lower end of the outer housing.

17. The sprinkler of claim 11 wherein the inlet valve assembly includes a metering assembly and the velocity control disc is positioned between the metering assembly and a circular base of the valve member.

18. The sprinkler of claim 11 wherein the inlet valve assembly includes an upper pressure chamber and a passage for venting the upper pressure chamber.

19. The sprinkler of claim 11 wherein the inlet valve assembly includes a cover member and the valve member is supported for reciprocating movement by a flexible hinge valve member connected to the cover member.

20. A pop-up sprinkler, comprising:

an outer housing having an inlet at its lower end;

a riser reciprocably mounted in the outer housing and moveable between retracted and extended positions in response to the introduction of pressurized fluid into the outer housing through the inlet;

a nozzle mounted in an upper end of the riser;

a turbine mounted in the riser;

drive means for coupling the turbine to the nozzle so that water flowing through the turbine will rotate the nozzle; and an inlet valve assembly mounted in the outer housing below the riser including a reciprocable valve member, a metering assembly, an upper pressure chamber, a passage for venting the upper pressure chamber, and a cover member, the valve member being supported for reciprocating movement by a flexible hinge valve member connected to the cover member, the inlet valve assembly further including an elastomeric velocity control disc mounted on the valve member and positioned between the metering assembly and the valve member for engaging and disengaging a valve seat to initially meter the inflow of fluid through the inlet to the riser to limit a speed of movement of the riser to the extended position, the velocity control disk having a portion that is deflectable radially inwardly to accommodate a particle of debris lodged between the velocity control disk and the valve seat, the valve member having an inwardly tapered wall and the portion of the velocity control disc normally being separated from the tapered wall to define a gap therebetween.

* * * * *